US009109533B2

(12) United States Patent
Budliger et al.

(10) Patent No.: US 9,109,533 B2
(45) Date of Patent: Aug. 18, 2015

(54) STIRLING MACHINE

(76) Inventors: Jean-Pierre Budliger, Onex (CH); Rolf Schmid, Obenwangen b. Bern (CH)

( * ) Notice: Subject to any disclaimer, the term of this patent is extended or adjusted under 35 U.S.C. 154(b) by 302 days.

(21) Appl. No.: 13/636,614

(22) PCT Filed: Mar. 29, 2011

(86) PCT No.: PCT/CH2011/000065

§ 371 (c)(1),
(2), (4) Date: Oct. 16, 2012

(87) PCT Pub. No.: WO2011/123961

PCT Pub. Date: Oct. 13, 2011

(65) Prior Publication Data

US 2013/0031899 A1 Feb. 7, 2013

(30) Foreign Application Priority Data

Apr. 6, 2010 (CH) ..... 0496/10

(51) Int. Cl.

| | |
|---|---|
| ***F01B 29/10*** | (2006.01) |
| ***F02G 1/043*** | (2006.01) |
| ***F02G 1/047*** | (2006.01) |
| ***F02G 1/053*** | (2006.01) |

(52) U.S. Cl.

CPC ..... *F02G 1/0435* (2013.01); *F02G 1/043* (2013.01); *F02G 1/047* (2013.01); *F02G 1/0535* (2013.01); *F02G 2243/202* (2013.01); *F02G 2244/52* (2013.01); *F02G 2253/02* (2013.01); *F02G 2253/04* (2013.01); *F02G 2270/30* (2013.01); *F02G 2270/40* (2013.01); *F02G 2270/80* (2013.01); *F02G 2280/10* (2013.01); *F02G 2280/20* (2013.01)

(58) Field of Classification Search

None

See application file for complete search history.

(56) References Cited

FOREIGN PATENT DOCUMENTS

| | | | |
|---|---|---|---|
| EP | 0218554 | A1 | 4/1987 |
| GB | 2033489 | A | 5/1980 |
| WO | WO 00/61936 | A1 | 10/2000 |

*Primary Examiner* — Christopher Jetton

(74) *Attorney, Agent, or Firm* — Bret E. Field; Bozicevic, Field & Francis LLP

(57) ABSTRACT

This Stirling machine comprises a transfer piston (6, 6*a*) and a moving part (14) of a generator or of an electric motor, the transfer piston (6, 6*a*) periodically displacing a working gas between an expansion chamber ($V_E$) and a compression chamber ($V_c$) which chambers are respectively associated with two working faces of the transfer piston (6, 6*a*) of which the cross-sectional area ratio $a_c/a_E$ is >0.35 so that its displacement along an axis X oriented towards the expansion volume ($V_E$) generates an in-phase working gas pressure component $P_x$ that opposes the displacement of the piston (6, 6*a*), so that all of the mechanical energy produced is transmitted to the moving part (14). This machine comprises a resonant second piston (10) coupled to the transfer piston (6, 6*a*) by a quantity of energy that is proportional to the pressure component $P_x$.

17 Claims, 5 Drawing Sheets

STIRLING MACHINE

The present invention relates to a Stirling machine comprising a displacer piston and a moving member of a generator or of an electric motor, the displacer piston being mounted in a cylinder, in which it periodically displaces a working gas between an expansion chamber and a compression chamber which constitute the working volume of said Stirling machine, respectively associated with two working faces of said displacer piston by causing said gas to pass through a hot side heat exchanger, linked to a heat source, a regenerator and a cooling exchanger linked to a heat sink and elastic return means exerting a force on this displacer piston, the cross-sectional area ratio $a_C/a_E$ between the two working faces of said piston being ≥0.35 so that its displacement along an axis oriented toward the expansion volume generates an in-phase pressure component of said working gas opposing said displacement of said piston, so as to transmit all of said mechanical energy produced between this displacer piston and said moving member.

One type of Stirling engines consists of a displacer piston which periodically displaces the working gas between a hot volume and a cold volume and a power piston which seals the working volume and ensures the transfer of the mechanical energy produced to the moving part of an electrical generator. In the kinematic engines, the two pistons are linked by a mechanical system with a crankshaft, which imposes upon them a repetitive periodic movement, with a fixed offset.

In the engines with free pistons, the two pistons are provided with elastic suspensions, dimensioned so as to confer on the two pistons a periodic movement at the desired frequency, with a prescribed phase shift. The absence of linkages simplifies the construction of these engines: by eliminating the articulations, the problems of lubrication thereof are eliminated. On the other hand, these engines often require complex control systems to ensure their startup and to stabilize the oscillating movement of the two pistons with determined amplitudes and phase angles.

A Stirling engine, developed by the American company Sunpower Inc. Athens, Ohio is described in an article entitled "Development of a 3 kW free-piston Stirling Engine" by G. Chen and J. McEntee, Proceedings of the 26th Intersociety Energy Conversion Engineering Conference, vol. 5, p. 233-238, in which a part of the motive energy is induced by the forces of the gas on the displacer piston, then transmitted by a pneumatic spring to the power piston. In this engine, the displacer piston therefore serves not only to transfer the gas between the hot and cold volumes situated at the two ends of the cylinder in which the piston is displaced, but also to generate a portion of the motive energy.

EP 1,165,955 describes an engine in which all of the motive energy is produced using the displacer piston, with which is associated the moving part of the electrical generator. A resonance tube is coupled to this device, in which a pressure wave is created which is phase-shifted in relation to the excitation wave produced by the displacer piston. The drawback of this solution lies essentially in the energy losses brought about by the friction of the gas in the tube which limit the performance levels of these engines. Moreover, the bulk of the resonance tube presents, in many applications, a not inconsiderable drawback.

JP 2127758 U illustrates, in FIG. 3, a Stirling machine in which the displacer piston is linked by a linkage to an electric motor. With this arrangement, the amplitude of the displacer piston is controlled mechanically, thus making the use of a flexible abutment superfluous. This machine also comprises a working piston and a load. In this configuration, only a fraction of the energy produced can be transmitted to the electric motor associated with the displacer piston.

The aim of the present invention is to remedy, at least partly, these drawbacks, to simplify the control of the cycle of the Stirling machine and to increase its operating stability, and to enhance its performance levels.

To this end, the subject of this invention is a Stirling machine as defined by claim 1.

The main advantage of the invention compared to the Stirling machines with two pistons according to the prior art lies in the fact that the resonant piston no longer needs to be servocontrolled, making it possible to eliminate any active servocontrol requiring complex electronics.

Advantageously, the resonant piston of the machine that is the subject of the invention is a free piston, suspended by a mechanical spring and which delimits the working volume. This resonant piston therefore fulfils a function similar to that of the resonance tube described in the patent EP 1,165,955. The mechanical and thermal losses brought about by the frictions and the leakages through the seals of the pistons are significantly more reduced than those of a resonance tube. By its movement, the pressure of the working gas varies. This resonant piston can be incorporated compactly in the volume of the Stirling machine.

With appropriate dimensioning, the two pistons oscillate in a stable manner. The operation of the system can easily be controlled, both in the starting phase and in steady-state operation, as will be explained in detail hereinbelow.

Other features and advantages of the machine that is the subject of the invention will become apparent on reading the following description, and the appended drawings, which illustrate, schematically and by way of example, two embodiments and a variety of variants of this machine.

Figure 1:
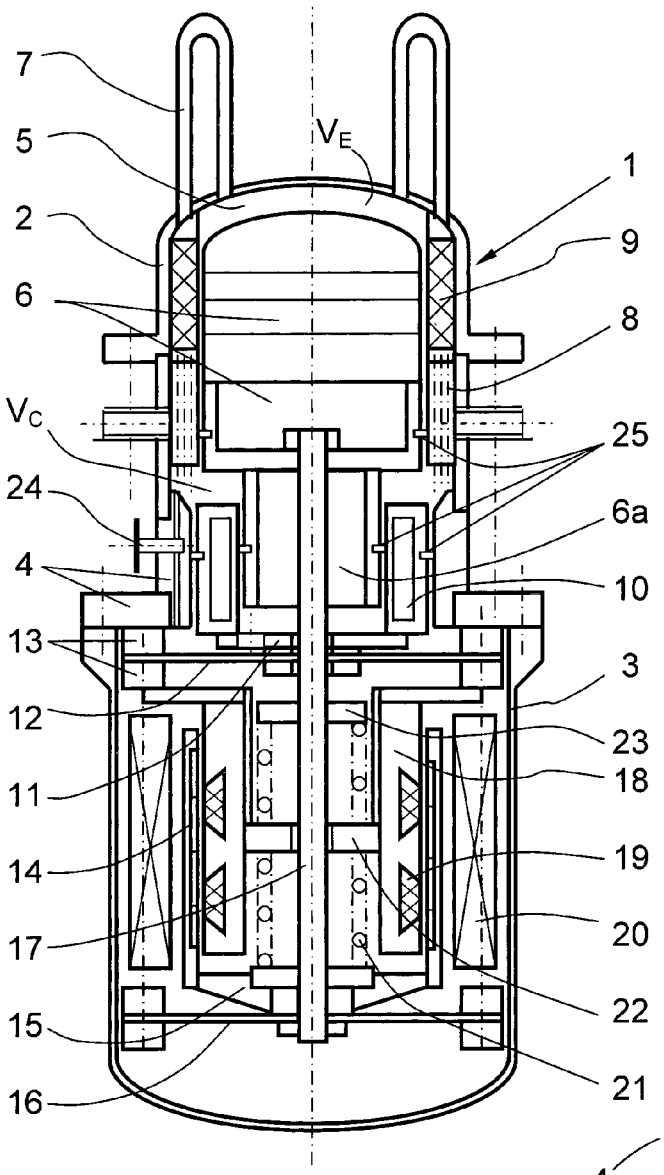
FIG. 1 is a diametral cross-sectional view of one embodiment.

The Stirling machine illustrated by FIG. 1 comprises an elongate housing 1 formed by two cylindrical parts 2, 3, joined by an element 4, which acts as frame. The interior of this housing 1 is filled with a pressurized working gas. The cylindrical recess 5 of the part 2 constitutes a working volume of a Stirling engine, in which a displacer piston in two parts 6, 6*a* is mounted, free to be displaced longitudinally. The volume situated between the displacer piston 6, 6*a* and the outer end of the recess 5 communicates with a hot side heat exchanger 7 linked to a hot source (not represented) and constitutes the hot chamber or expansion volume $V_E$ of the Stirling engine, whereas the volume situated at the other end of this cylindrical recess 5 communicates with a cold side heat exchanger 8 linked to a cold source (not represented), which constitutes the cold chamber or compression volume $V_C$ of the Stirling engine. A regenerator 9 is arranged between the hot 7 and cold 8 side heat exchangers.

The tubular part 6*a* of the displacer piston 6, 6*a* adjacent to the compression chamber $V_C$ is engaged in the cylindrical opening of a second resonant piston 10 which is annular and axisymmetric in relation to the piston 6, 6*a*. This second piston 10, attached to a support 11 is free to be displaced along the longitudinal axis of the cylindrical recess 5.

An elastic suspension member 12 is fixed by its central part to the support 11 and by its periphery to a support 13 which is attached to the frame 4. This elastic suspension member 12 is a flat member with arms in spiral form. In the variant illustrated by FIG. 3A, the resonant piston 10 is suspended on the frame 4 by helical springs 12A, arranged symmetrically about the axis and exerting an axial force on the piston, centered in relation thereto.

Leak-tight seals 25 placed between the pistons 6*a* and 10, on the one hand, and between these pistons and the cylindrical recess 5, on the other hand, serve to contain gas leakages to tolerable levels.

The internal volume of the cylindrical part 3 encloses a moving member 14 of an electrical generator, here consisting of a cylindrical element bearing permanent magnets. This moving element 14 is attached to the periphery of an annular support 15, the internal edge of which is attached to an annular elastic suspension member 16, similar to the member 12. The periphery of this member 12 is fixed to the frame 4 and its center is attached to a rod 17, one end of which is fixed to the displacer piston 6, 6*a*. The rotor of the generator is formed by an assembly of plates 18, arranged radially and in which are housed one or more windings 19 of annular form. The moving element 14 of the electrical generator is surrounded by an armature 20, here formed by an assembly of plates arranged in radial planes.

The elastic suspension of the displacer piston 6, 6*a* can be reinforced by one or more helical springs 21, arranged between fixed supports 22, attached to the frame 4 and moving supports 23, attached to the rod 17.

A duct including an adjustment valve 24 placed between the cold compression volume and the volume of the generator makes it possible to adjust the working gas pressure amplitude, and therefore the power of the engine. This valve also makes it possible to adjust the amplitude of the movement described by the resonant piston.

Figure 2:
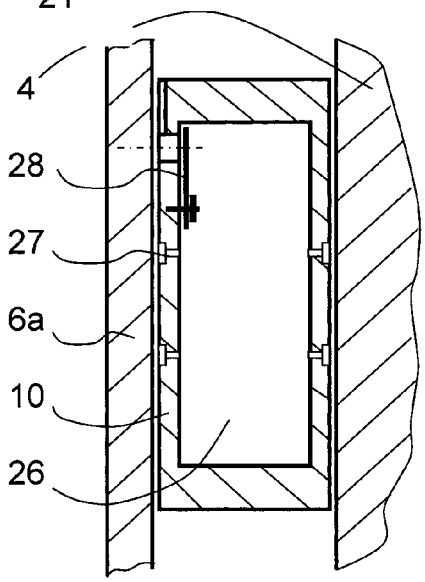
FIG. 2 is a partial diametral cross-sectional view of a variant of the machine.

FIG. 2 shows a partial diametral cross section through the second resonant piston 10, illustrating an alternative solution of the cylindrical bearing surfaces of the two pistons 6*a* and 10. In place of the leak-tight seals, it is advantageous to provide, between the cylindrical surfaces of the pistons and their chambers, annular slots with gaps of the order of 20 to 50 microns, as guiding and support means. These gaps are perfectly acceptable both from the point of view of the manufacturing tolerances and of the influence of the leakages of working gas on the energy efficiency of these devices. The mechanical frictions of the pistons can be reduced with wear-resistant and self-lubricating surface coatings capable of reducing the static and dynamic friction. In a preferred embodiment, provision is also made to use static gas bearings, as are described in U.S. Pat. No. 3,127,955.

To this end, the interior of the piston 10 is hollow, forming a recess 26 serving as a gas tank for feeding nozzles 27 opening into the annular slots between the two pistons 6*a* and 10, respectively between the pistons and the adjacent surfaces of the elongate housing 1, respectively of the wall of the piston 6*a*. The compartment 26 is fed through a non-return valve 28 from the working volume and maintained permanently at the maximum pressure prevailing in this volume. The compartment 26 can also be placed in the displacer piston 6, 6*a* or in the frame 4, to feed the nozzles 27 of the static gas bearings.

Figure 3:
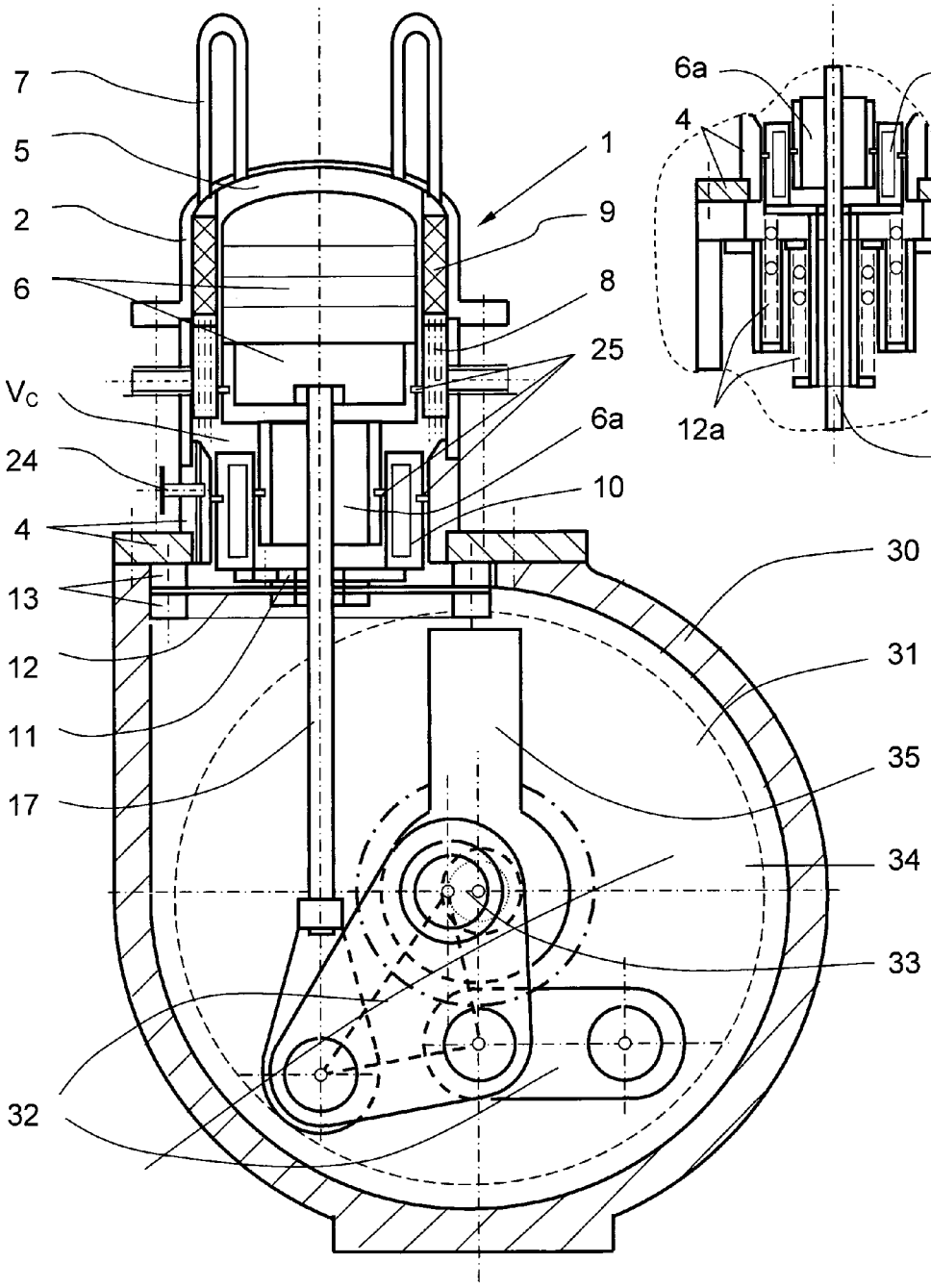
FIG. 3 is a diametral cross-sectional view of a hybrid variant.
Figure 3A:
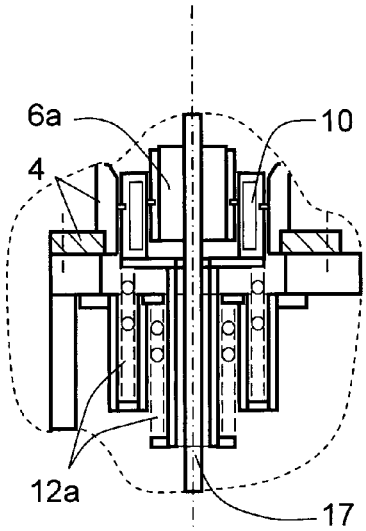
FIG. 3A is a partial view of a variant of FIGS. 1 and 3.

FIG. 3 represents a hybrid variant in which the recess 5 of the part 2 with the pistons 6, 6*a* and 10 forming the driving part of the Stirling are similar to the embodiment described above. The part 2 is linked to a compartment 30, comprising a rotary electrical generator 31. The displacer-power piston 6, 6*a* is linked by a rod 17 to a linkage 32 which transmits the movements and axial forces of the piston 6, 6*a* to a crankshaft 33, attached to the moving part of a rotary electrical generator 31.

Different embodiments of the linkages can be envisaged. In FIG. 3, a Ross-type linkage is sketched, as is described in detail for example in the proceedings of the 8th International Conference on Stirling engines held between 27 and 30 May 1997 in Ancona. Page 519 ff describes the design of the linkage, that makes it possible to minimize the lateral displacement of the rod in relation to its movement axis. Other embodiments of the linkages can be envisaged, such as, for example, the trapezoidal linkage used by Philips (for example represented on page 60 of the proceedings of "Stirling Cycle Prime Movers" seminar held on 14 and 15 Jun. 1978).

The moving part of the electrical generator can be provided with an inertia flywheel 34, making it possible to balance the rotary movement and thus to smooth the waves superimposed on the electrical voltage generated. Moreover, a mass 35 makes it possible to attenuate the vibrations due to the reciprocating movement of the pistons.

The Stirling machine described operates as follows: the movement of the second resonant piston 10 is dictated by the forces communicated by the elastic elements and the pressure of the gas which is exerted on its axial surfaces. By its movement, the pressure of the working gas varies.

The displacer piston 6, 6*a* then has a dual function of transferring the working gas between the expansion chamber $V_E$ and the compression chamber $V_C$ and of producing all the driving energy transmitted to the moving member 14 of the linear generator, provided that certain conditions, which will now be described, are fulfilled.

To achieve this objective, it is necessary to determine the ratio between the surface $a_C$ of the displacer piston 6, 6*a*, delimiting the compression volume $V_C$ and the surface $a_E$ of this same displacer piston 6, 6*a*, delimiting the expansion volume $V_E$.

The analysis of the isotherm cycle shows that the pressure of the working gas in the working volume becomes independent of the position of the displacer piston 6, 6*a* if:

$$\frac{a_C}{a_H} = \frac{T_C}{T_H}$$

EXAMPLE

Temperature $T_H$ of the hot volume $V_E$, $T_H$=923° K.=650° C.

Temperature $T_C$ of the cold volume $V_C$, $T_C$=323° K.=50° C. $a_C/a_E \geq 0.35$ The operation of the engine is possible only if the surface ratio $a_C/a_E$ is greater than this limit, that is to say that the displacement of the displacer piston 6, 6*a* (FIG. 4) must induce a pressure component $P_X$ which must oppose the displacement X of this piston 6, 6*a*. The displacement of the displacer piston 6, 6*a* is positive if the latter is displaced toward the volume $V_E$.

This displacer-power piston can be designed as a free piston. Its elastic suspension must then be tuned so that the piston oscillates at the same frequency as the resonant piston. Its amplitude is controlled by the electrical forces exerted by the generator; it remains fixed if a constant electrical load is applied to the terminals of the electrical generator.

In a hybrid machine, the piston 6, 6*a* is linked mechanically to the axis of the moving part of a rotary electrical generator by a linkage. The travel of the piston 6, 6*a* is then fixed by the geometry of this linkage. Its speed of rotation is controlled electrically by the electrical generator and its frequency must correspond to that of the second resonant piston 10.

Figure 4:
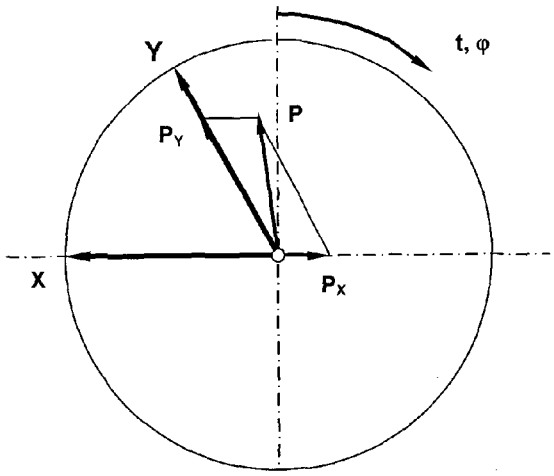
FIG. 4 is a vector diagram relating to the operating process.

FIG. 4 represents a vector diagram illustrating the most important features of the system, the time t running in the clockwise direction. The vector X represents the displacement of the displacer-power piston 6, 6*a*, the vector Y that of the resonant piston 10. In resonance conditions, Y is retarded relative to X. By its displacement, the displacer-power piston 6, 6*a* creates a low pressure variation $P_X$, opposite to X. The displacement Y of the resonant piston 10 creates a pressure variation $P_Y$ in the direction of Y, the pressure variation P of the working gas being the sum of the two components $P_X$ and $P_Y$.

On each cycle, the resonant piston 10 receives a certain quantity of energy, proportional to the pressure component $P_X$ which keeps this piston moving. Since $P_X$ depends on the heating temperature $T_H$, the amplitude Y of the resonant piston 10 varies as a function of this temperature $T_H$. Since the pressure amplitude $P_Y$ is proportional to Y, the latter and the mechanical power generated by the Stirling engine increase strongly with the heating temperature $T_H$.

Figure 5:
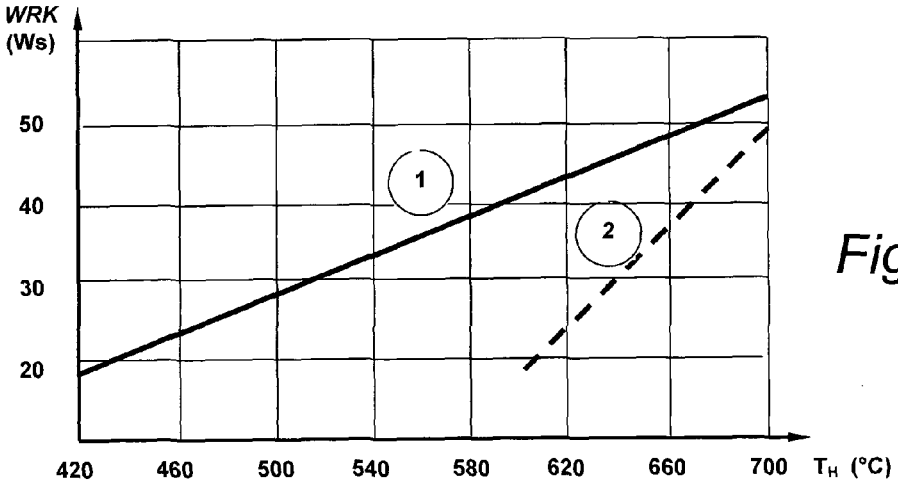
FIG. 5 is a diagram relating to the work supplied per cycle as a function of the temperature of the hot side heat exchanger, for an engine according to the invention, compared to an engine comprising a displacer piston and a power piston.

FIG. 5 compares the mechanical energy released by a Stirling engine comprising a displacer piston and a working piston, as a function of the temperature $T_H$ of the heating tubes (curve 1) with that of an engine according to the invention (curve 2). To start the Stirling machine that is the subject of the invention, the hot side heat exchanger must first be raised to a relatively high temperature $T_H$ (for example 600° C.), a threshold which depends on the ratio $a_C/a_E$ that is chosen. The displacer-power piston 6, 6*a* is then made to oscillate using the electrical generator which is associated with it. The resonant piston 10 is first made to oscillate with a low amplitude, which increases gradually with the heating temperature $T_H$. The amplitude of the pressure of the working gas also increases, as does the mechanical power supplied by this machine. The nominal power is reached when the hot side heat exchanger is raised to approximately 700° C.

The Stirling engines with a displacer piston and a power piston already start at significantly lower heating temperatures (approximately 300 to 400° C. depending on their design). The power then increases gradually with the temperature $T_H$, to reach, in comparable nominal conditions, a power similar to that of the machine that is the subject of the invention.

In the machine that is the subject of the invention, a small increase in the temperature of the hot side heat exchanger results in a strong increase in the power developed by this engine. Through the expansion of the gas in this hot part, the thermal power drawn-off also increases strongly with this temperature. The stability of the speed of the engine therefore depends specifically on the supply of heat to the hot side heat exchanger and it can be adjusted by simple means. Since the temperature $T_H$ is accurately controlled by the power released by the engine, the risk of overheating of the hot part is minimal.

Figure 6:
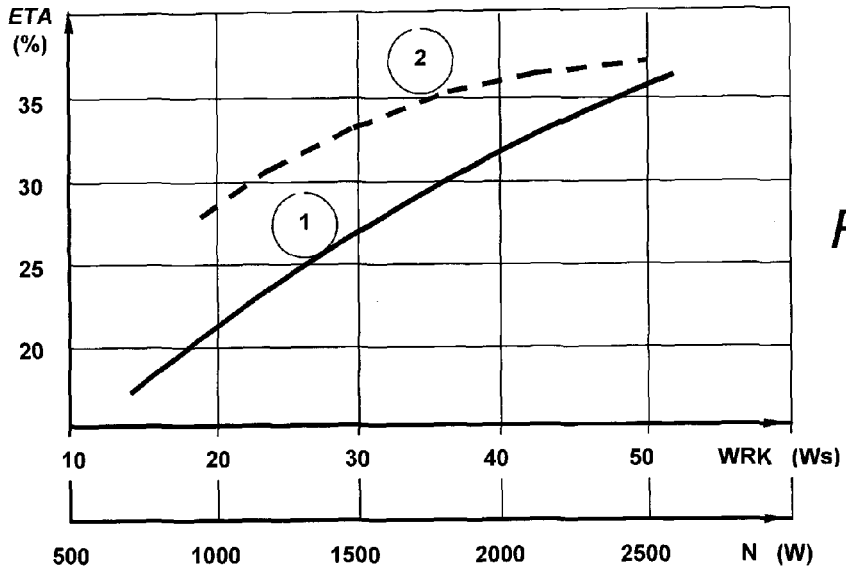
FIG. 6 is a diagram relating to the thermal efficiency of the Stirling engine as a function of the work supplied per cycle, for an engine according to the invention compared to an engine comprising a displacer piston and a power piston.

FIG. 6 compares the thermal efficiency ETA of the conventional machine (curve 1) with that of the machine according to the invention (curve 2), plotted as a function of the energy produced per cycle (WRK). At nominal speed, the two machines have comparable performance levels. At partial load, the Stirling machine according to the invention works at levels of heating temperature $T_H$ significantly higher than the conventional machine, therefore in conditions which favor the conversion of the thermal energy into mechanical energy. Thus, the machine according to the invention makes it possible to reach much higher thermal efficiencies ETA within a wide range of partial loads.

In the machine according to the invention, the resonant piston 10 receives, on each cycle, a small quantity of energy which is used to compensate its losses by friction and to maintain its oscillating movement. The amplitude of its movement Y determines the pressure variation of the working gas and therefore the speed of the engine. A fine adjustment is possible inasmuch as the friction of the piston remains relatively constant over time since it can be obtained by using the above-mentioned static gas bearings. Moreover, the adjustment valve 24 makes it possible to adjust the working gas pressure amplitude, and therefore the amplitude of the resonant piston.

The use of a resonant piston makes it possible to have the system operate with a light working gas, such as, for example, pure helium, whereas a resonance tube operates better with a mixture of heavier gas. The losses in the heat exchange members of the Stirling machine (heating, regenerator, cooler) depend on the density of the gas and are lower in the case of the present invention.

The fact that the temperatures $T_H$ of the hot side heat exchanger vary only very little with the load of the engine proves particularly advantageous in the units heated with fuels. As a general rule, the operation of a burner is greatly dependent on the temperature conditions which are set up therein; a complete combustion with a minimum of pollutants can be obtained only if the temperature conditions remain sufficiently stable.

An in-depth study has made it possible to highlight these advantages for burners that use an internal recirculation of the combustion gases, a technique applied in various forms for Stirling engines (see DE 102,17913 A1). By diluting the oxidant, a flameless combustion is set up in the combustion chamber, occupying a large proportion of this volume. A complete combustion can be obtained with a very small excess of air if a number of conditions are satisfied, in particular:

the temperature of the mixture formed by the supply of fresh air and the recycled gases must be situated above the ignition temperature of the fuel; for natural gas in a diluted atmosphere, this threshold is situated above 720° C.;

to avoid the massive formation of $NO_x$, the temperature of the gases must nowhere exceed the limit of 1300 to 1400° C.;

the temperature $T_H$ of the surfaces of the hot side heat exchanger is established with a balance between the energy released upon combustion and that drawn from the hot side heat exchanger by the expansion of the working gas of the Stirling. The operating conditions in the conditions of DE 102,17913 remain satisfactory within a wide power range, provided that $T_H$ varies only a little with the power of the engine, as is the case with the Stirling engine that is the subject of the invention.

The conventional free-piston Stirling machines require sophisticated adjustment means (for example U.S. Pat. No. 6,871,495, or U.S. 2008/0122408) to keep the speed of the engine under control, both during the machine starting phase, and to stabilize the operation around nominal conditions. In these machines, a deviation from the optimum operating conditions can greatly reduce the performance levels of these engines.

The control of the Stirling machine that is the subject of the invention proves significantly more simple, mainly for the following reasons: the two pistons are primarily coupled with the chamber of the system and only secondarily together. The beating between the two pistons of the machine that is the subject of the invention can thus easily be damped, even totally eliminated. Moreover, the burner of this Stirling machine responds more rapidly to a power variation since its temperature changes only a little with the thermal power transferred. Any variation of $T_H$ of the hot source modifies $P_X$ and therefore the power transferred to the resonant piston, resulting in a rapid change of its amplitude Y. The pressure amplitude is thus modified, which adjusts the power of the engine.

In the free-piston Stirling engines designed according to the prior art, the movement of the displacer piston depends on the pressure variations of the working gas. A small variation of its amplitude results in a variation of the quantity of energy exchanged between the regenerator and the gas which passes through it; this influences the instantaneous pressure of the working gas, which in turn influences the movement of the displacer piston. An instability can thus occur, which can be controlled only indirectly by the action of the electrical generator on the power piston.

In the present invention, the amplitude of the movement of the displacer piston is directly controlled by the electrical generator which is associated with it. The variations of its amplitude are thus directly controlled by the load applied to the electrical generator, thus preventing any notable disturbance relative to the nominal cycle of the engine. By virtue of this quality of control, these engines can operate with significant pressure amplitudes and thus reach power densities greater than those which can be controlled in the known configurations.

Figure 7:
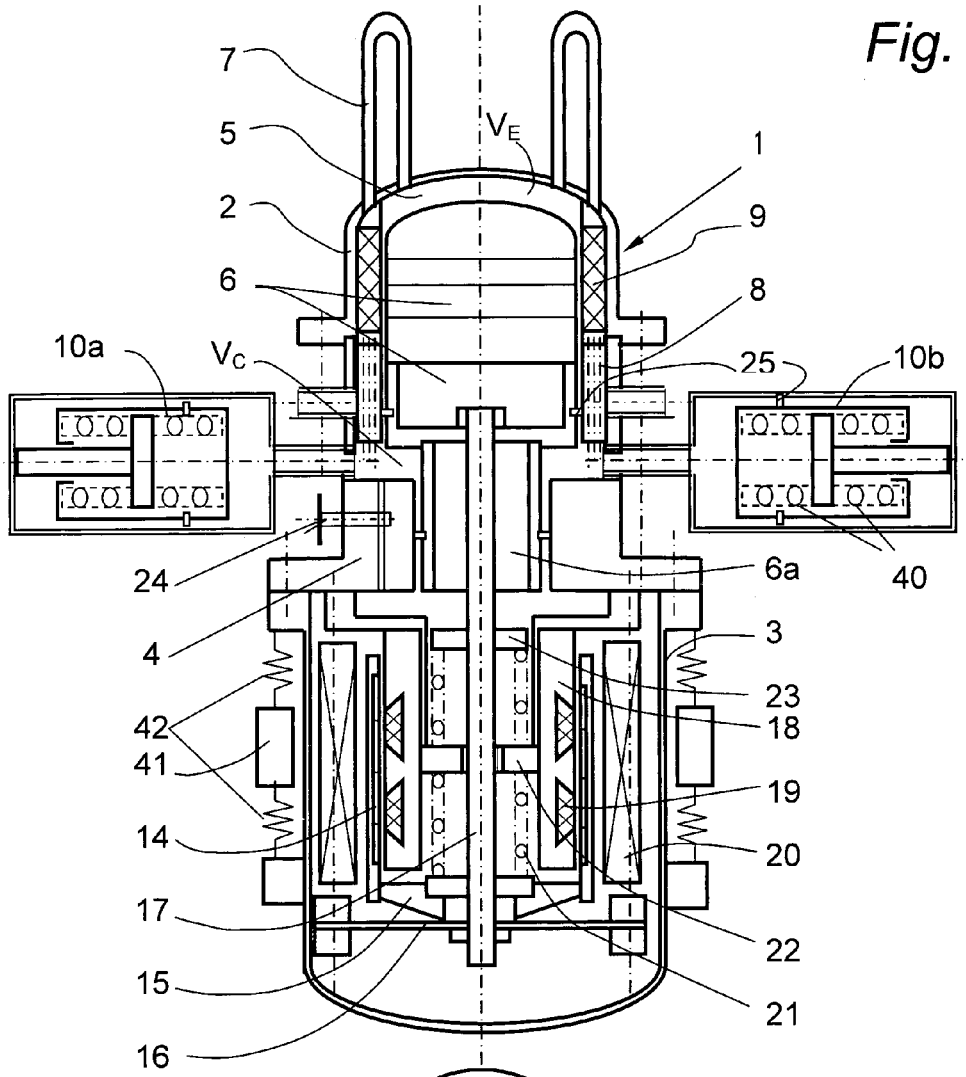
FIG. 7 is a diametral cross-sectional view of another embodiment of the machine, comprising two resonant pistons oscillating in opposite directions.

FIG. 7 shows in diametral cross section a configuration of the Stirling machine comprising two resonant pistons 10*a*, 10*b* arranged in external cylinders and linked to the compression volume $V_C$ of the Stirling engine. The two resonant pistons are suspended with elastic means 40 in their respective cylinders. The mass of each piston and the mechanical and pneumatic elastic forces acting thereon are adjusted to confer on these pistons a resonant frequency equal to the frequency of operation of the machine. The two subassemblies formed by these pistons 10*a*, 10*b* and their cylinders are identical. The two pistons 10*a*, 10*b* are coaxial and arranged symmetrically in relation to the axis of the machine. Under the action of the variable pressure of the machine, the two resonance pistons oscillate in opposite directions and their inertia forces compensate one another.

Figure 8:
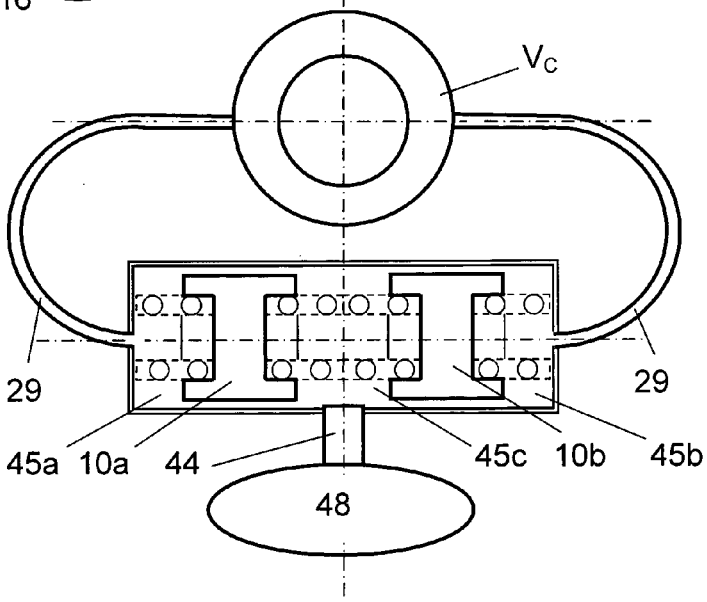
FIG. 8 is a transversal cross-sectional view of a variant of FIG. 7.

In the variant of FIG. 8, the two pistons 10*a* and 10*b* are arranged coaxially in a common cylinder positioned laterally to the main axis of the machine. The two outer volumes 45*a* and 45*b* of the common cylinder are linked to the compression volume $V_C$ of the Stirling engine by ducts 29. The central volume 45*c* can be linked by a duct 44 to a volume 48 exposed to an almost constant average pressure, for example that of the volume of the electrical generator. When these two pistons 10*a* and 10*b* oscillate under the action of a variable pressure, their inertia forces cancel one another. As a variant, the central volume 45*c* can be linked to the cold chamber $V_C$ and the outer volumes 45*a* and 45*c* to the volume 48. By positioning a number of pairs of coaxial resonant pistons 10*a*, 10*b* symmetrically in relation to the main axis of the machine, the lateral force exerted by all of these resonant pistons 10*a*, 10*b* is cancelled, inasmuch as all of these resonant pistons describe the same movement.

Figure 9:
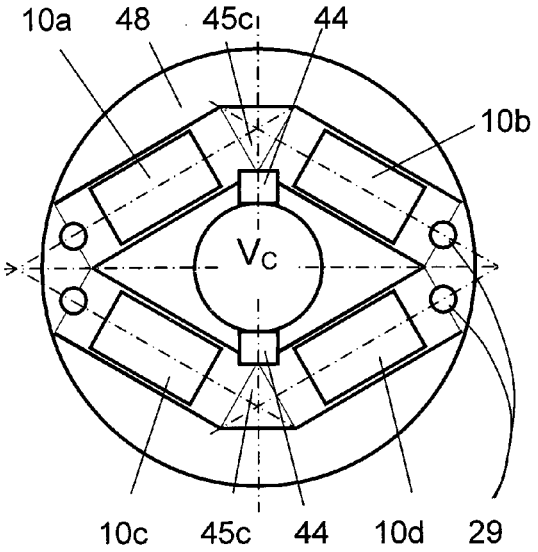
FIG. 9 is a schematic diagram illustrating a transversal cross section of the machine, at the level of the resonant pistons.

FIG. 9 illustrates, as an example, an arrangement of the resonant pistons 10*a*, 10*b*, 10*c*, 10*d* in rhomboid form. This makes it possible to position them with their cylinders in a chamber of small diameter. No lateral force is exerted by these resonant pistons on the whole of the machine inasmuch as their movements are identical. More generally, the inertia forces of these resonant pistons 10*a*, 10*b*, 10*c*, 10*d* are cancelled if these pistons are arranged in the form of a symmetrical arrangement in relation to the main axis of the machine.

One recurrent problem with free-piston Stirling machines is caused by the significant vibratory forces transmitted to the frame by the oscillating pistons. To reduce the sound nuisances transmitted outward, these machines have to be placed in acoustic chambers and insulated from the ground. Moreover, the vibrations of the frame can be reflected on the speed of these machines and thus risk disrupting their operation.

These vibrations can be compensated with 2 identical machines, arranged around a common combustion chamber and oriented in mutually opposite directions. These tandem assembly arrangements have been proposed, for example, in the ICSC paper 95-26 by the company Sunmachine (Proceedings of the 7th International Conference on Stirling Cycle Machines, November 1995, Tokyo). These solutions are particularly suited to machines developing relatively high powers.

FIG. 7 illustrates a known means for attenuating the vibrations of the frame, comprising an additional mass 41, suspended by elastic means 42 on the chamber 3, attached to the frame 4 of the machine. By adjusting the specific frequency of this resonator to the operating frequency of the machine, it is possible to reduce the vibration thereof. However, if the tuning is not accurate enough, beating can result therefrom risking the creation of nuisances and disrupting the operation of the machine.

Figure 10:
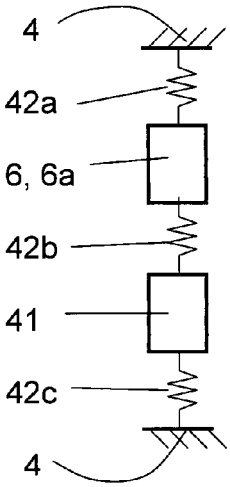
FIG. 10 is a schematic diagram illustrating a device that can be used to reduce the vibrations induced by the periodic movement of the displacer piston using an additional mass.

In order to at least partly remedy this drawback, the present invention proposes another system that makes it possible to attenuate the vibrations transmitted to the chamber of the machine, illustrated by FIG. 10. According to this design, the additional mass 41 is linked elastically to the displacer piston 6, 6*a* and to the frame 4 of the machine. The elastic suspensions 42*a, b* and *c* are adjusted so that, at the operating frequency of the machine, these two masses oscillate in mutually opposing directions, so that the vibratory forces transmitted to the chamber or to the frame of the machine are cancelled out. The vibrations generated by the movement of the pistons are thus reduced at the source.

The elastic means 42*a, b* and *c* can consist of spiral or flat mechanical springs, electromagnets, pneumatic means or combinations of these different elastic supports. This vibration-suppression system makes it possible to effectively compensate the action of a single oscillator. It is therefore particularly suited to the Stirling machines that comprise opposing resonant masses, given that only the vibrations generated by the displacer piston have to be compensated.

Figure 11:
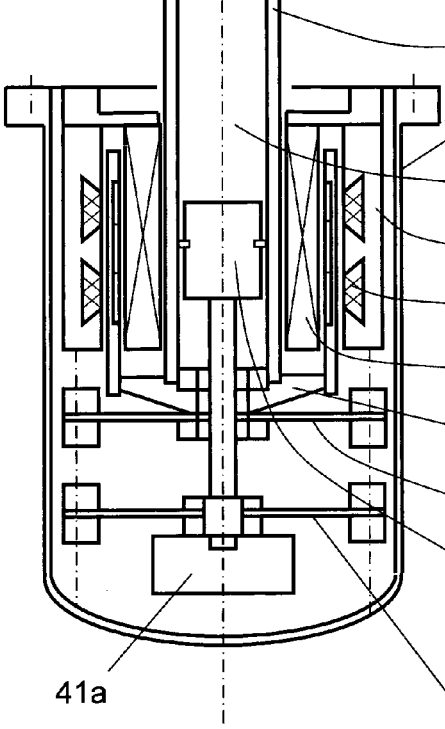
FIG. 11 is a partial diametral cross-sectional view of a variant of the machine.

FIG. 11 illustrates, by way of example, the cylindrical compartment 3 of a Stirling machine. In this embodiment, the additional mass 41 forms a moving piston, placed inside an extension of the tubular element of the piston 6*a*, delimiting a volume 46 of a pneumatic spring 42*b*. This additional mass 41 in the form of a piston can be provided with sealing segments 25. As a variant, the sealing of the volume 46 can be ensured by the cylindrical surfaces of the piston formed by the additional mass 41 and by the wall of its tubular chamber, by forming a very small annular space between the cylindrical wall of the piston and that of the tubular chamber. This annular space can, moreover, be provided with an inert gas bearing to stabilize the radial position between the additional mass 41 and the tubular extension of the piston 6*a*, thus reducing the frictions between these two surfaces.

This additional mass 41 is centered and suspended elastically by a mechanical spring, preferably by a flat spring with spiral arms 42*c*. An auxiliary mass 41*a*, associated with the additional mass 41 is used to adjust the oscillations of this additional mass, so that the displacer piston 6, 6*a* and the additional mass 41 oscillate in phase opposition; the vibratory forces transmitted to the frame can thus be reduced to the minimum.

As is indicated in this figure, the rotor and the windings can surround the moving part of the generator and the armature can be placed inside the latter.

Figure 12:
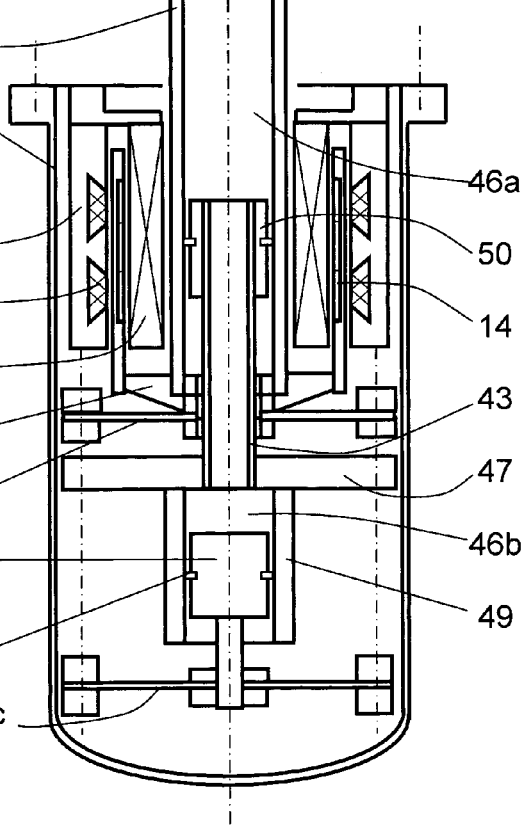
FIG. 12 is a variant of the diametral cross section of FIG. 11.

FIG. 12 illustrates a variant of FIG. 11 in which the additional mass 41 is housed in an auxiliary cylinder 49 fixed to a support 47 rigidly linked to the frame 4 of the machine. The pneumatic spring 42*b* of FIG. 10 is then made up of a first variable volume 46*a* situated in the extension of the displacer piston 6, 6*a* and delimited by a stationary piston 50. This volume 46*a* is linked by a tube 43 to a second volume 46*b*, situated in the auxiliary cylinder 49. The tube 43 is fixed rigidly to the support 47, attached to the frame 4 of the machine, and it passes through the stationary piston 50.

The two variable volumes 46*a* and 46*b* are tightly sealed by means of moving or fixed pistons, provided with leak-tight seals 25 or smooth surfaces with a very small radial gap relative to their respective cylinders. The latter can be provided with inert gas bearings to reduce the friction losses.

In the embodiment according to FIG. 12, the oscillating masses 6, 6*a* and 41 are guided separately by respective supports. This solution ensures optimum buoyancy for these moving elements, minimizing their radial movements and their friction losses. The drawback with this solution lies in the relatively significant bulk.

Many variant embodiments of the system with two oscillating masses can be envisaged. For example, the variant according to FIG. 12 may comprise a cylindrical moving mass 41 which surrounds a stationary piston, attached to the support 47. Moreover, in all these variants, additional mechanical springs can be used to reinforce the action of the pneumatic spring 42*b*.

The absence of a complex and costly servocontrol system, the reduction of the vibrations generated by these machines and the favorable operating conditions under partial loads offer considerable advantages in many applications, such as, for example:

for domestic heating, it can operate in spring and autumn at partial load, with a minimum of installation stoppages/startups. The energy losses linked to each startup are thus avoided and the fatigue of the metals subjected to frequent thermal cycles is reduced. Moreover, the flexibility of the system makes it possible to better adapt the operation to domestic electrical energy needs and to better manage the storage of domestic hot water.

In biomass combustion, the heat released can fluctuate according to the quality of the fuel. With the machine that is the subject of the invention, the temperature of the heating tubes varies little, so that a stable combustion is maintained in optimum conditions.

The flexibility of the system and the good efficiencies at partial load make it possible to better convert solar energy, for example in the morning, in the evening or when it is overcast. On an annual average basis, the Stirling machine that is the subject of the invention therefore allows for operation for a longer time period than the conventional systems.

The use of rotary generators makes it possible to generate three-phase current which can easily be injected into an electricity network.

The hybrid engines described above are also distinguished by good efficiencies at partial load. They can advantageously be used in all the applications that require great operating flexibility.

On startup, the movement of the resonant mass and the pressure amplitude thus generated are small. The machine can then be switched on without balancing the pressures between the different volumes: the use of a short-circuit valve which is generally used in the conventional kinematic machines is therefore no longer necessary.

The invention claimed is:

1. A Stirling machine comprising:

a displacer piston (6, 6*a*) comprising two working faces, a generator or an electric motor comprising a moving member, a cylinder (2), an expansion chamber (VE) and a compression chamber (VC) which constitute the working volume of said Stirling machine within said cylinder, a hot side heat exchanger (7) linked to a heat source, a regenerator (9), and a cooling exchanger (8) linked to a heat sink, and an elastic return means exerting a force on the displacer piston (6, 6*a*), the displacer piston (6, 6*a*) being mounted in said cylinder (2), in which it periodically displaces a working gas between the expansion chamber (VE) and the compression chamber (Vc), respectively associated with the two working faces of said displacer piston (6, 6*a*) and causing said gas to pass through said hot side heat exchanger (7), regenerator (9), and cooling exchanger (8), the cross-sectional area ratio (aC/aE) between the two working faces of said piston (6, 6*a*) being greater than or equal to 0.35 so that its displacement along an axis X oriented toward the expansion volume (VE) generates an in-phase pressure component $P_x$ of said working gas opposing said displacement of said piston (6, 6*a*), so as to transmit all of said mechanical energy produced between this displacer piston (6, 6*a*) and said moving member (14), characterized in that:

the ratio of cross-sectional area (aC/aE) is less than 0.70, and the Stirling machine further includes at least one resonant piston (10), coupled to said displacer piston (6, 6*a*) by a quantity of energy proportional to said pressure component $P_x$.

2. The Stirling machine as claimed in claim 1, in which said resonant piston is a free piston guided via support means.

3. The Stirling machine as claimed in claim 1, in which the displacer piston is suspended by elastic means, thus forming a free piston, said moving member exhibiting linear displacement.

4. The Stirling machine as claimed in claim 1, in which the displacer piston is linked to said rotary moving member by a mechanical linkage.

5. The Stirling machine as claimed in claim 1, in which the ratio of the working surfaces $a_C/a_E$ of the displacer piston (6, 6*a*) is between 35 and 60%.

6. The Stirling machine as claimed in claim 1, in which each piston is guided in a radial direction by a dynamic seal formed by a radial gap of between 20 μm and 50 μm, at least one of the two surfaces of which being provided with a wear-resistant and self-lubricating coating capable of reducing the static and dynamic friction.

7. The Stirling machine as claimed in claim 1, in which the dynamic seals formed between the pistons and the cylinders which surround them are pressurized with the working gas contained in at least one volume of gas formed in the walls of the cylinder or in the pistons.

8. The Stirling machine as claimed in claim 7, in which said volume of gas is provided with at least one non-return valve placed in proximity to a volume exposed to pressures that are variable in time, and supplied with working gas when this volume is exposed to the highest cyclic pressures.

9. The Stirling machine as claimed in claim 1, in which each piston is a free piston suspended from the cylinder by a flat spring with spiral-shaped arms.

10. The Stirling machine as claimed in claim 1, in which the resonant piston (10) and/or the displacer piston are suspended from the frame (4) by helical springs, positioned symmetrically about the axis of said piston or pistons and exerting an axial force on said piston or pistons, centered in relation to this or these pistons.

11. The Stirling machine as claimed in claim 1, in which an adjustment valve is provided on a duct which links the cold working volume with the volume of the electrical generator.

12. The Stirling machine as claimed in claim 1, comprising at least one pair of similar coaxial resonant pistons, positioned symmetrically in relation to the axis of the machine and oscillating in opposite directions.

13. The Stirling machine as claimed in claim 1, comprising at least two pairs of similar resonant pistons (10*a*, 10*b*, 10*c*, 10*d*), positioned in the form of a symmetrical arrangement in relation to the main axis of said machine.

14. The Stirling machine as claimed in claim 1, in which an additional mass (41*a*) is suspended from the frame by elastic means (42*c*), so that its natural frequency is adjusted to that of the displacer piston (6, 6*a*) of the machine and that its oscillating movement compensates the vibrations of said displacer piston (6, 6*a*).

15. The Stirling machine as claimed in claim 1, in which the additional mass (41*a*) is suspended from the frame of the machine and from said displacer piston (6, 6*a*) by elastic means (42*c*) adjusted so that, at the operating frequency of said displacer piston (6, 6*a*) of the machine, this mass oscillates in direction opposite to that of the displacer piston.

16. The Stirling machine as claimed in claim 15, in which a pneumatic spring (46*a*) links the displacer piston (6, 6*a*) to the pneumatic spring (46*b*) of the additional mass (41) and is at least partly incorporated in a tubular element (6*a*) situated in an extension of the displacer piston (6, 6*a*).

17. The Stirling machine as claimed in claim 1, in which the ratio of the working surfaces $a_C/a_E$ of the displacer piston (6, 6*a*) is between 40 and 55%.

* * * * *